US006667753B2

(12) United States Patent
Kaya

(10) Patent No.: US 6,667,753 B2
(45) Date of Patent: Dec. 23, 2003

(54) DEVICE FOR DETECTING A LEADING EDGE OF A RECORDING PAPER

(75) Inventor: Akimasa Kaya, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 70 days.

(21) Appl. No.: 10/123,188

(22) Filed: Apr. 17, 2002

(65) Prior Publication Data

US 2002/0154205 A1 Oct. 24, 2002

(30) Foreign Application Priority Data

Apr. 18, 2001 (JP) ..... 2001-120156

(51) Int. Cl.[7] ..... B41J 11/00; B41J 11/54

(52) U.S. Cl. ..... 347/177; 400/596

(58) Field of Search ..... 347/177, 176, 347/178, 218, 172, 186, 19, 14, 104, 105; 400/120.01, 120.02, 42, 28, 596, 611, 642

(56) References Cited

U.S. PATENT DOCUMENTS 5,087,925 A * 2/1992 No et al. ..... 347/177
5,140,340 A * 8/1992 Stephenson ..... 347/177
5,148,187 A * 9/1992 Ono et al. ..... 347/218
5,882,130 A * 3/1999 Kumazaki et al. ..... 400/642
6,078,345 A * 6/2000 Yamakawa et al. ..... 347/218
6,297,841 B1 * 10/2001 Takeda ..... 347/186

FOREIGN PATENT DOCUMENTS

JP 2000-169013 6/2000

* cited by examiner

*Primary Examiner*—Lamson Nugyen
*Assistant Examiner*—K. Feggins
(74) *Attorney, Agent, or Firm*—Sughrue Mion, PLLC

(57) ABSTRACT

A separator abuts on a leading edge of a recording paper to separate it from a periphery of a paper roll when the paper roll is rotated forward in a paper feeding direction. The separator is attached to a supporting arm, which is urged by a spring so as to move the separator in accordance with a change of a diameter of the paper roll. The separator is provided with a vibration detecting sensor. While the paper roll is rotated backward in a winding direction, the vibration detecting sensor outputs a signal to a controller. This signal has a level corresponding to a scale of vibration. The controller detects the leading edge from the signal level when a head portion of the separator has overleapt the leading edge of the recording paper.

19 Claims, 9 Drawing Sheets

DEVICE FOR DETECTING A LEADING EDGE OF A RECORDING PAPER

BACKGROUND OF THE INVENTION

1. Field of the Invention

The present invention relates to a device for detecting a leading edge of a recording paper. This device is employed in a printer and a paper magazine using a paper roll of a thermosensitive recording paper, a printing paper and so forth.

2. Description of the Related Art

It is known that some of photographic printers and color thermal printers use a paper roll formed by rolling a strip of a recording paper. The paper roll is contained in a paper supply section of the printer, and is rotated by a driving mechanism so as to be rotated forward in a paper feeding direction and so as to be rotated backward in a rewinding direction. A flange having a rotary shaft is attached to the paper roll. As to ways for supporting the rotary shaft, there are a fixation type and a movement type. In the fixation type, the rotary shaft of the paper roll is rotatably supported at a fixed position. In the movement type, a drive roller abutting on a periphery of the paper roll is provided, and the rotary shaft is moved toward the drive roller in accordance with a diameter change of the paper roll.

Upon rotating the paper roll forward, the recording paper is advanced from the paper supply section to a print section to execute a printing process. After printing, the printed recording paper is cut in a predetermined size and is discharged to the outside of the printer. A region of the recording paper, which has been advanced to the print section but has not been used for printing, is rewound by rotating the paper roll backward. When rewinding the recording paper, there arises a problem in that looseness of winding is caused because the printing paper and the thermosensitive recording paper have a paper thickness and a paper strength.

In order to prevent the looseness of winding, Japanese Patent Laid-Open Publication No. 2000-169013 discloses a method in which the paper roll is rotated backward so as to be securely wound before feeding the paper. After securely winding the paper roll, the recording paper is fed. This method employs a detecting device for a leading edge of the recording paper. This detecting device (hereinafter, leading-edge detecting device) abuts on a peripheral surface of the paper roll to detect the leading edge thereon. Secure winding of the paper roll is judged when a detection interval of the leading-edge detecting device becomes constant during the reverse rotation of the paper roll.

The leading-edge detecting device comprises a basic roller, an actuation lever, a driven roller, and a micro switch. The basic roller abuts on the periphery of the paper roll. The actuation lever rotates around the basic roller. The driven roller is disposed on the actuation lever. When the driven roller overleaps the leading edge of the recording paper, the micro switch outputs a detection signal in response to the movement of the actuation lever.

The actuation lever is urged by a first spring so as to contact the driven roller with the periphery of the paper roll. Meanwhile, the basic roller is supported by a roller supporting lever to which a second spring is attached to contact the basic roller with the periphery of the paper roll. One end of the first spring is attached to the actuation lever, and the other end thereof is attached to the roller supporting lever.

The micro switch is disposed at a fixed position in the paper supply section.

However, the above unit for detecting the leading edge has problems in that a number of parts thereof is large and a structure thereof is complicated. Particularly, in the rotary-shaft fixing type, a moving amount of the actuation lever is large in comparison with the rotary-shaft moving type. Thus, there arises another problem in that it is necessary to separately provide a mechanism for moving the micro switch together with the actuation lever.

SUMMARY OF THE INVENTION

In view of the foregoing, it is a primary object of the present invention to provide a device for detecting a leading edge of a recording paper, in which the reading edge is detected with a simple structure.

It is a second object of the present invention to provide a device for detecting a leading edge of a recording paper, in which a number of parts thereof is reduced.

In order to achieve the above and other objects, the leading-edge detecting device according to the present invention comprises an abutting member contacting with a periphery of a paper roll, and a vibration detecting sensor for detecting a vibration of the abutting member. The vibration detecting sensor outputs a signal in accordance with a scale of the vibration, and is preferable to be attached to the abutting member.

The paper roll is formed by rolling a strip of a recording paper. While the paper roll is rotated backward in a winding direction, the abutting member overleaps a leading edge of the recording paper every rotation thereof. When the abutting member has overleapt the leading edge, the vibration detecting sensor outputs the signal having a higher level. On the basis of the signal of the higher level, disengagement of the leading edge and the abutting member is judged to detect the leading edge.

In a preferred embodiment, the abutting member is a separator for separating the leading edge from the paper roll. When the paper roll is rotated forward in a paper feeding direction, a head portion of the separator abuts on the lading edge to separate it from the paper roll.

A rotary shaft is set to the paper roll. In a case that the rotary shaft is adapted to be held at a fixed position, it is preferable to provide a drive roller, a first supporting arm, and a first spring. The drive roller abuts on the periphery of the paper roll to rotate it. The first supporting arm moves the drive roller in accordance with a diameter change of the paper roll. The first spring urges the first supporting arm so as to contact the drive roller with the paper roll.

Further, it is preferable to provide a second supporting arm and a second spring. The second supporting arm supports the abutting member. The second spring urges the second supporting arm so as to contact the abutting member with the periphery of the paper roll. The second spring is attached to the first supporting arm so as to move together with the second supporting arm.

According to the present invention, a structure of the leading-edge detecting device may be simplified, and a number of parts thereof may be reduced by utilizing the separator used for separating the leading edge from the periphery of the paper roll. Further, the vibration detecting sensor is attached to the separator so that it is unnecessary to provide a special mechanism for moving the vibration detecting sensor.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 1:
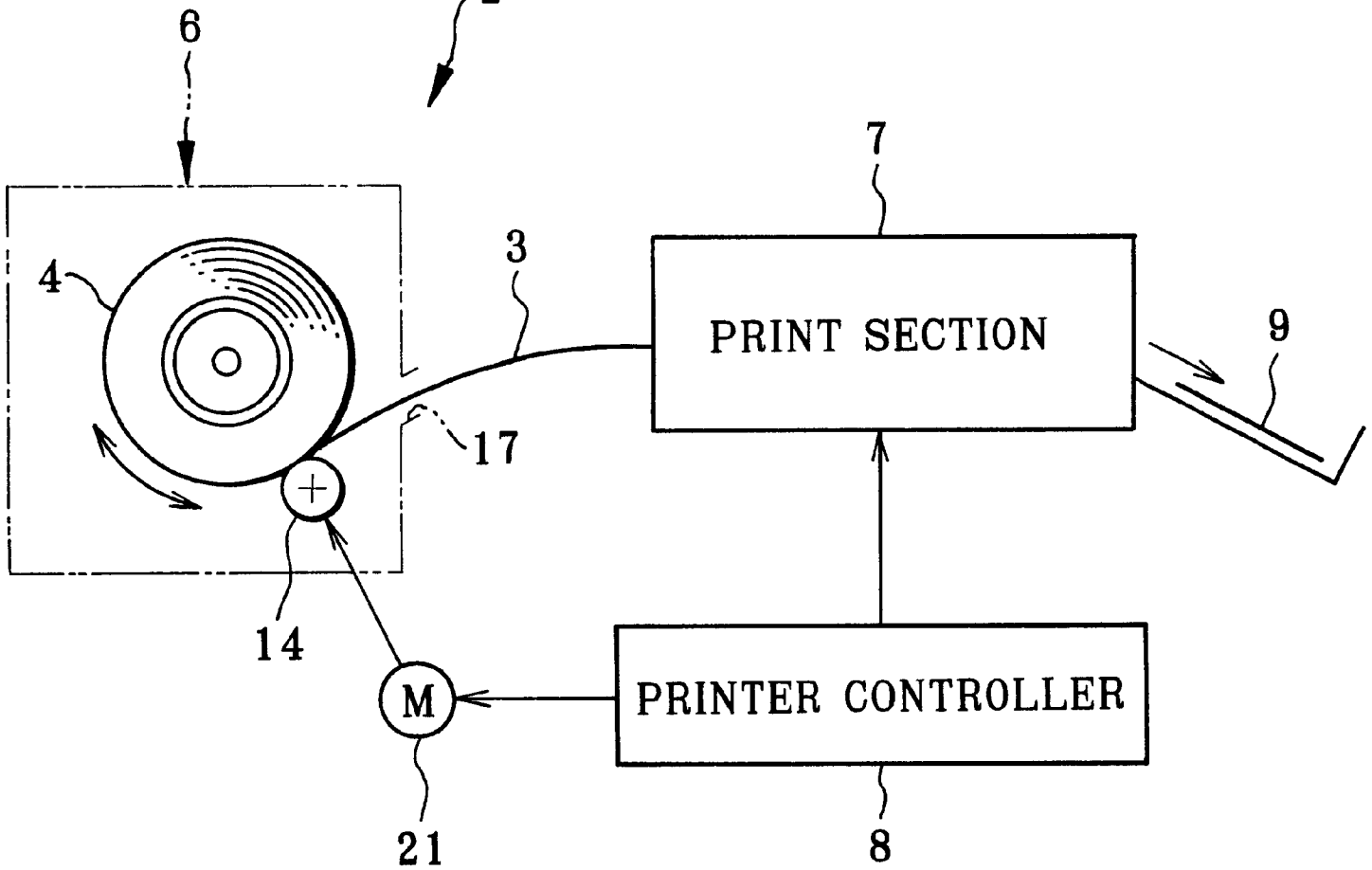
FIG. 1 is an explanatory illustration of a printer.

A color thermal printer 2 shown in FIG. 1 comprises a paper supply section 6, a print section 7, and a printer controller 8. The paper supply section 6 contains a paper roll 4 formed by rolling a strip of a recording paper 3. The print section 7 executes a printing process on the recording paper 3 fed from the paper supply section 6. The printer controller 8 controls the print section 7 and so forth. The recording paper 3 is a well-known color thermosensitive recording paper including a cyan thermosensitive coloring layer, a magenta thermosensitive coloring layer, and a yellow thermosensitive coloring layer, which are formed on a base in order.

The print section 7 is provided with a conveyor roller pair, a thermal head, a fixing unit, and so forth. The conveyor roller pair nips a leading edge of the recording paper 3 and conveys the recording paper 3 inside the print section 7. The thermal head performs thermal recording on the respective thermosensitive coloring layers of the recording paper 3. The fixing unit optically fixes the respective thermosensitive coloring layers, on which thermal recording has been performed, with ultraviolet rays.

Upon instruction of printing, the paper roll 4 contained in the paper supply section 6 is rotated backward in a winding direction to carry out secure winding. After that, the paper roll 4 is rotated forward in a paper feeding direction. The recording paper 3 is fed to the print section 7 through a paper mouth 17. The fed recording paper 3 is conveyed inside the print section 7 by means of the conveyor roller pair. When the recording paper 3 passes the thermal head and the fixing unit, the printing process is performed in a three-color frame-sequential manner to print an image in full color. The printed recording paper 9 is cut by a cutter in a predetermined size to be discharged to the outside of the printer 2. Meanwhile, the recording paper 3 from which the printed recording paper 9 has been separated is rewound into the paper supply section 6 through the paper mouth 17 by rotating a drive roller 14.

As to the printer 2, it is possible to assign a print number at the time of print instruction. When the assigned print number is a plural number, the printing process is continuously performed plural-number times corresponding to the assigned print number. After the continuous processes have been over, the recording paper 3 is rewound.

Figure 2A:
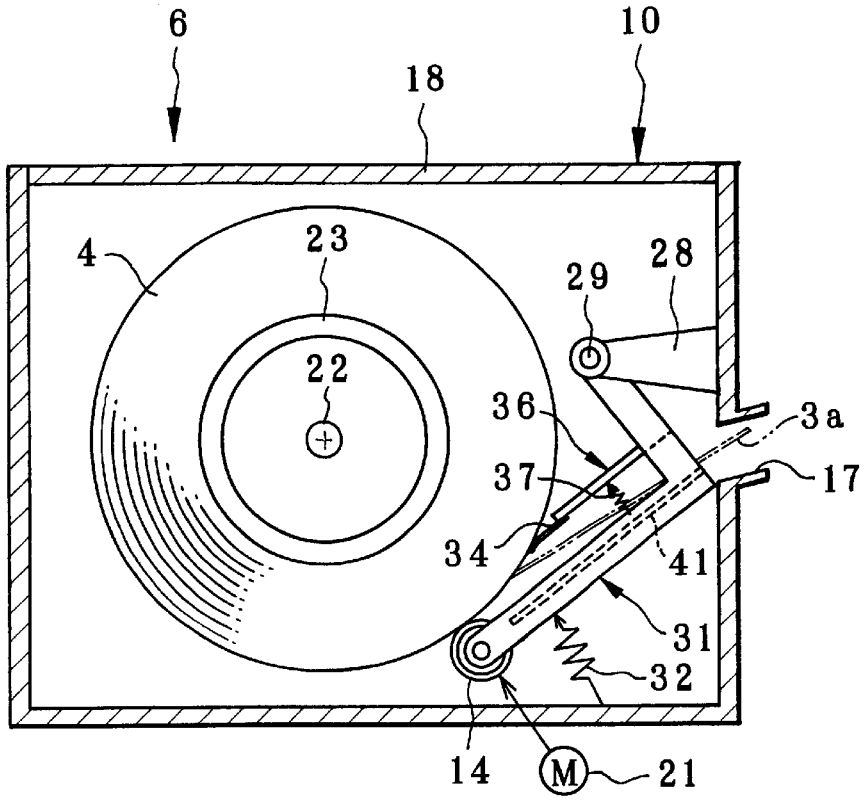
FIGS. 2A and 2B are section views of a paper supply section of the printer.
Figure 2B:
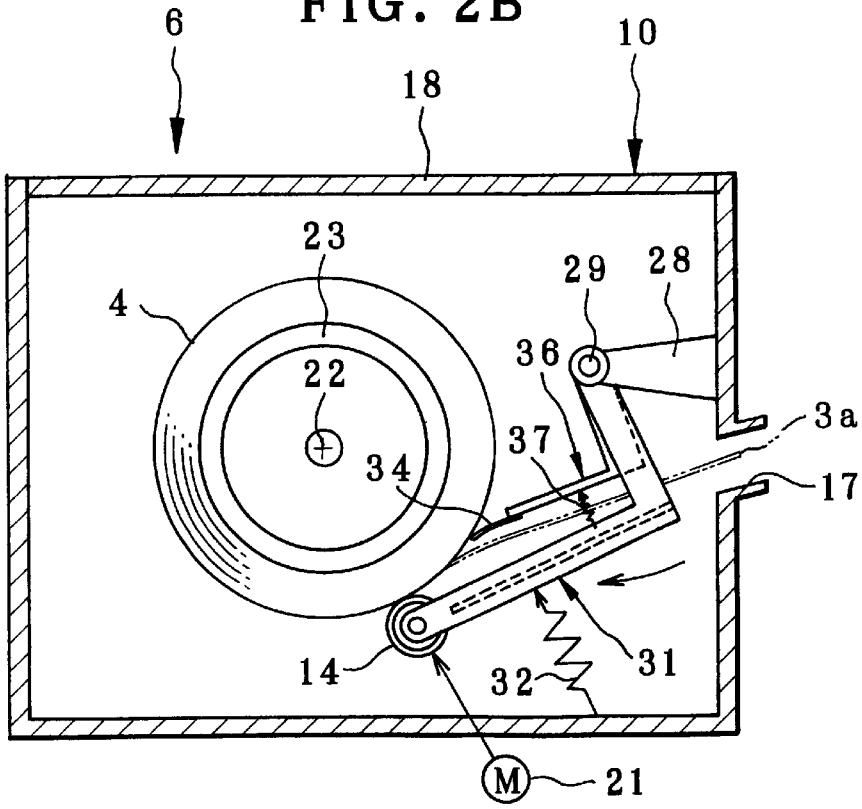

The paper supply section 6 has a light-shielding ability and a moisture-retention ability. As shown in FIGS. 2A and 2B, the paper supply section 6 comprises a case 10 containing the paper roll 4, and the drive roller 14 abutting on a periphery of the paper roll 4. The drive roller 14 rotates the paper roll 4 forward in the paper feeding direction, and rotates it backward in the winding direction.

A top face of the case 10 is adapted to be a detachable lid 18, for example. The paper roll 4 is loaded into the case 10 after detaching the lid 18. A flange 23 provided with a rotary shaft 22 is attached to both ends of the paper roll 4. An inner wall of the case 10 is formed with a support member (not shown) for rotatably supporting the rotary shaft 22 at a fixed position. The paper roll 4 is contained in the case 10 such that the rotary shaft 22 is supported by the support member.

The drive roller 14 comprises a metal shaft and a covering material applied on a peripheral surface thereof. The covering material prevents the drive roller 14 from slipping. As the covering material, a rubber is used for instance. The drive roller 14 is rotated by a drive motor 21 and is attached to a first supporting arm 31, which comprises a pair of L-shaped arm members 31*a* and 31*b* (see FIG. 3). The drive roller 14 is attached to ends of the respective arm members 31*a* and 31*b*. The other ends of the respective arm members 31*a* and 31*b* are attached to pivots 29 formed on a supporter 28. Owing to this, the first supporting arm 31 is rotatable around the pivot 29.

FIG. 2A shows an initial state of the paper roll 4, and FIG. 2B shows a state thereof in that a half or more of the recording paper 3 is used. As shown in FIGS. 2A and 2B, a diameter of the paper roll 4 changes as the recording paper 3 is used. The first supporting arm 31 moves the drive roller 14 in accordance with the change of the diameter. The first supporting arm 31 is urged by a first spring 32 so as to be rotated in a clockwise direction in FIGS. 2A and 2B. One end of the first spring 32 is fixed to the case 10, and the other end thereof is fixed to the first supporting arm 31. Alternatively, two ends of the first spring 32 may be respectively attached to the supporter 28 and the first supporting arm 31. With respect to the first spring 32, a coiled spring is used for instance. The first spring 32 supports the drive roller 14 so that a spring possessing a strong urging force is used.

The drive roller 14 is merely moved between the maximum diameter of the paper roll 4 and the minimum diameter thereof. In view of this, a rotational range of the first supporting arm 31 is regulated by a stopper, which is not shown, so as to rotate the first supporting arm 31 within a required range.

The drive roller 14 is pressed against the periphery of the paper roll 4 by means of the first spring 32. In virtue of this, the drive roller 14 always abuts on the periphery of the paper roll 4 regardless of the diameter change thereof. Thus, the paper roll 4 is adapted to be driven from beginning to end. By the way, when the paper roll 4 is reversed, the drive roller 14 contributes to the secure winding of the paper roll 4.

A separator 34 is disposed above the drive roller 14. The separator 34 elastically contacts with the peripheral surface of the paper roll 4. When the paper roll 4 is rotated forward in the paper feeding direction, the separator 34 abuts on a leading edge 3*a* of the recording paper 3 to separate it from the periphery of the paper roll 4. The separated leading edge 3*a* is guided to the paper mouth 17, and the recording paper 3 is fed into the print section 7.

Figure 3:
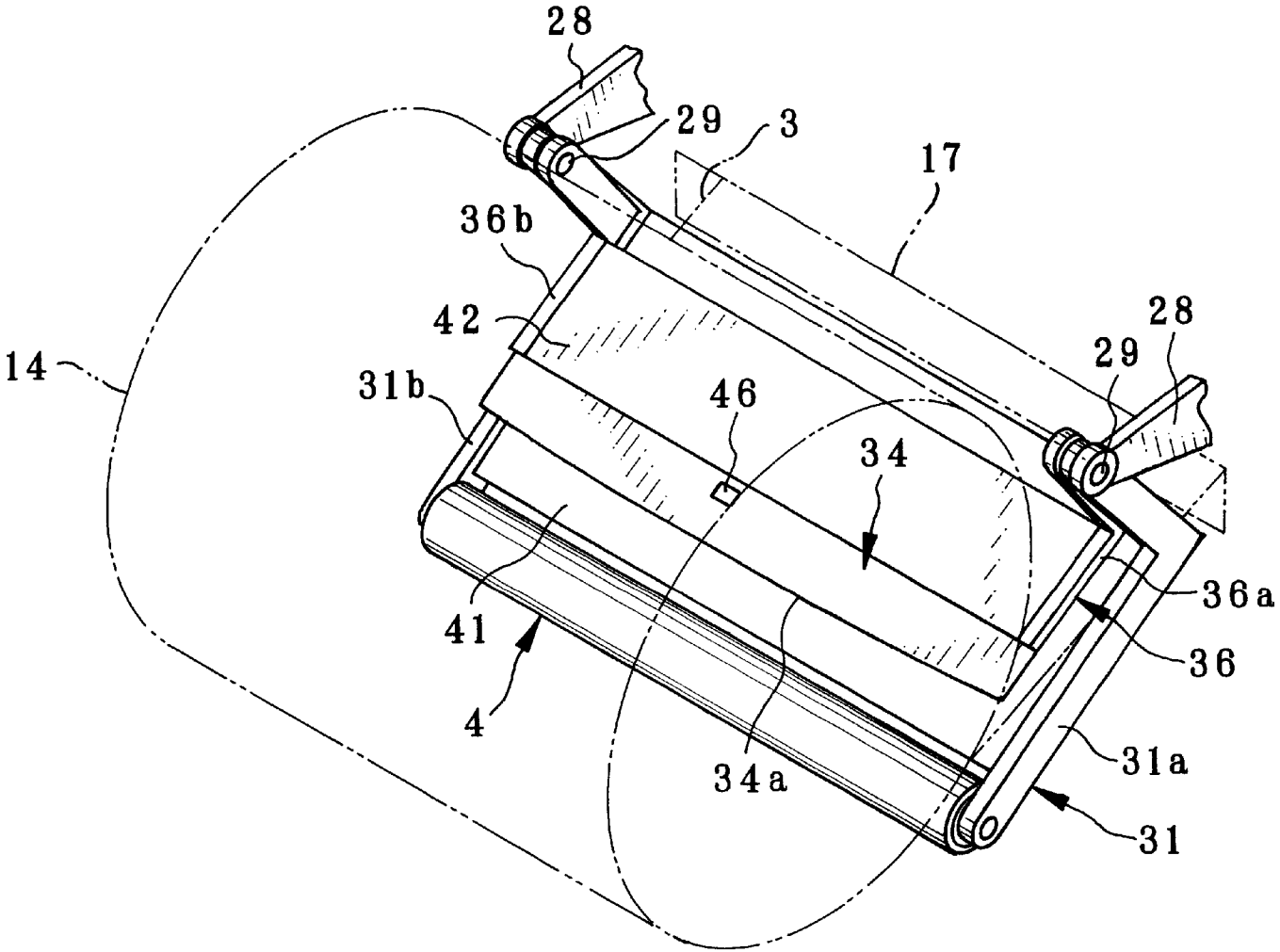
FIG. 3 is a perspective view showing a moving mechanism for a separator and a drive roller.

The separator 34 is a plastic thin plate having elasticity and is attached to a second supporting arm 36 comprising a pair of L-shaped arm members 36*a* and 36*b* (see FIG. 3). The separator 34 is attached to ends of the respective arm members 36*a* and 36*b*. The other ends of the respective arm members 36*a* and 36*b* are attached to the pivots 29 formed on the supporter 28. Owing to this, the second supporting arm 36 is rotatable around the pivots 29. Incidentally, similarly to the first supporting arm 31, a rotational range of the second supporting arm 36 is also regulated by a stopper, which is not shown, so as to rotate the second supporting arm 36 within a required range.

The second supporting arm 36 moves the separator 34 in accordance with the diameter change of the paper roll 4. The second supporting arm 36 is urged by a second spring 37 so as to be rotated in the clockwise direction in FIGS. 2A and 2B. In virtue of this, the separator 34 always abuts on the periphery of the paper roll 4 regardless of the diameter change thereof. It is possible to separate the leading edge 3*a* of the recording paper 3 from beginning to end.

The second spring 37 is attached in a state that one end thereof is put on the second supporting arm 36 and the other end thereof is put on the first supporting arm 31. As to the second spring 37, are used a coiled spring, a torsion spring, and so forth. In a case the torsion spring is used, the torsion spring is held by the pivot 29 for example, and both ends thereof are engaged with the first supporting arm 31 and the second supporting arm 32 respectively.

The urging force of the second spring 37 is weaker than that of the first spring 32. Owing to this, the second spring 37 is moved by the urging force of the first spring 32 together with the first supporting arm 31.

The second spring 37 is moved together with the first supporting arm 31 such as mentioned above so that the urging force of the second spring 37 for urging the second supporting arm 36 is prevented from largely changing. Thus, the separator 34 is pressed against the periphery of the paper roll 4 with constant force from beginning to end while the paper roll 4 is used. It is possible to surely separate the leading edge 3*a* of the recording paper 3 regardless of the diameter change of the paper roll 4.

As shown in FIG. 3, the first supporting arm 31 and the second supporting arm 36 are provided with guide plates 41 and 42 respectively. The guide plates 41 and 42 abut on the recording paper 3 in an up-and-down direction so as to guide the leading edge 3*a* toward the paper mouth 17. In virtue of the guide plates 41 and 42, the leading edge 3*a* is surely led to the paper mouth 17 even though the separator 34 is moved in accordance with the diameter change of the paper roll 4.

For the purpose of easily separating the recording paper 3 from the paper roll 4, the separator 34 is contrived so as to have some advantages. For instance, a thickness of the separator 34 is adapted to be half or less of a thickness of the recording paper 3. In doing so, even if the recording paper 3 closely contacts with the paper roll 4, they are easily separated. Moreover, a head portion 34*a* of the separator 34 may be formed in an arc shape so as to contact the head portion 34*a* with the leading edge 3*a* at a sole point in a width direction. In doing so, it is possible to deal with rigidity of the color thermosensitive recording paper having a paper thickness and a paper strength.

A vibration detecting sensor 46, which constitutes a leading-edge detecting device, is attached to an upper face of the separator 34. When the paper roll 4 is rotated backward in the winding direction, a vibration of the separator 34 contacting with the periphery of the paper roll 4 is converted into an electric signal by the vibration detecting sensor 46. The converted electric signal is sent to the printer controller 8. The vibration detecting sensor 46 outputs the electric signal whose level corresponds to a scale of the vibration. When the separator 34 vibrates, deformation and strain are caused thereon. In view of this, as the vibration detecting sensor 46, are used a piezoelectric element, a strain sensor, and so forth for detecting the deformation and the strain of the separator 34.

Figure 4:
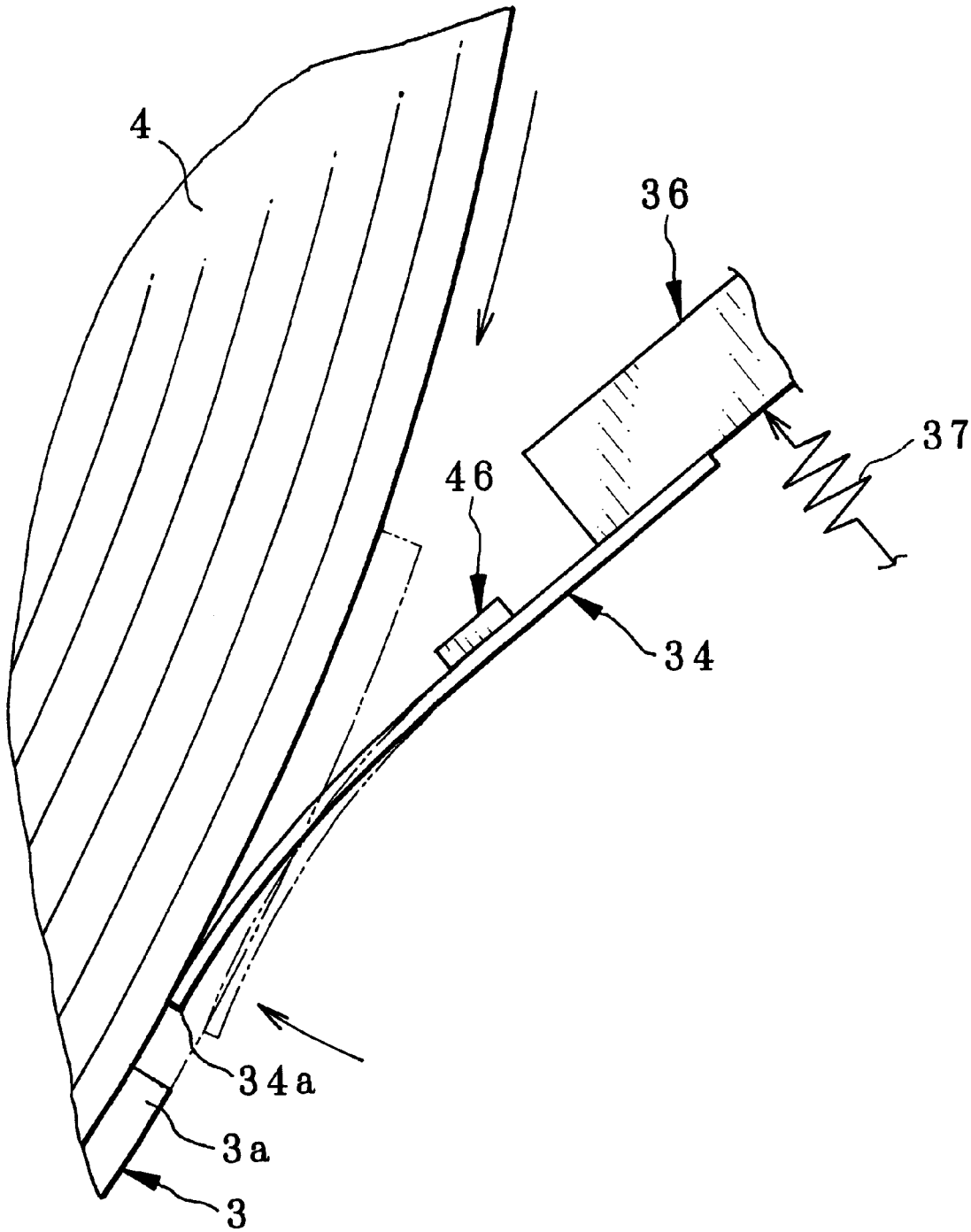
FIG. 4 is an explanatory illustration showing a movement of the separator when a leading edge of a recording paper passes the separator.

As shown in FIG. 4, the head portion 34*a* of the separator 34 is pressed against the peripheral surface of the paper roll 4 by means of the second spring 37. Thus, the separator 34 contacts with the paper roll 4 in a curvature state. When the leading edge 3*a* of the recording paper 3 passes the head portion 34*a* during the backward rotation of the paper roll 4, the head portion 34*a* overleaps the leading edge 3*a* owing to the elasticity of the separator 34 and the urging force of the second spring 37.

Figure 5:
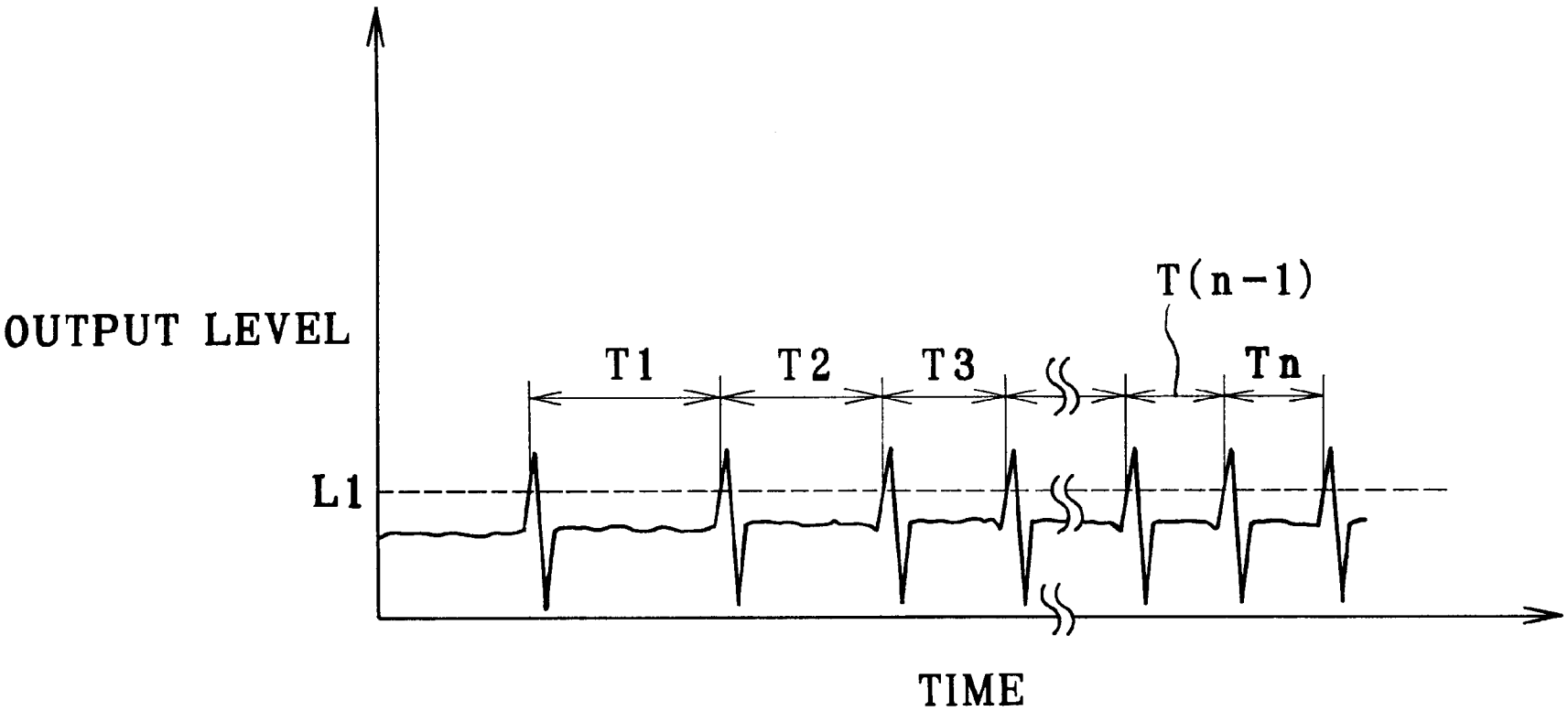
FIG. 5 is a graph showing a relationship between an output level of a signal, which is sent from a vibration detecting sensor, and a cycle T of detecting the leading edge when a paper roll is reversed.

FIG. 5 is a waveform showing the output level of the vibration detecting sensor 46 under a condition that the paper roll 4 is rotated backward. While the paper roll 4 is reversed, the separator 34 slightly vibrates in a state that the leading edge 3*a* does not pass the separator 34. In this state, the vibration detecting sensor 46 outputs the signal having a lower level corresponding to the scale of the vibration. Meanwhile, when the separator 34 overleaps the leading edge 3*a* of the recording paper 3, the separator 34 largely vibrates because the head portion 34*a* thereof is moved by an amount corresponding to the thickness of the recording paper 3. At this time, the output level of the vibration detecting sensor 46 is much higher than the others.

A memory included in the printer controller 8 stores a level L1 in advance as a threshold value, which is set between the output level of the large vibration and the other output levels. When the output level of the vibration detecting sensor 46 exceeds the level L1, the printer controller 8 judges that the separator 34 has overleapt the leading edge 3*a* of the recording paper 3. In this way, the leading edge 3*a* is detected.

The separator 34 is moved by the second supporting arm 36 and the second spring 37 in accordance with the diameter change of the paper roll 4. Since the second spring 37 is attached to the first supporting arm 31, the urging force thereof does not change largely from beginning to end while the paper roll 4 is used. Thus, the output level of the vibration detecting sensor 46 is substantially kept at a constant level from beginning to end while the paper roll 4 is used. Consequently, the output level is prevented from varying in accordance with the diameter change so that it is possible to stably detect the leading edge.

Further, since the separator 34 contacts with the paper roll 4 in the curvature state, the head portion 34*a* of the separator 34 comes into contact with the peripheral surface of the paper roll 4 actively when the head portion 34*a* has overleapt the leading edge 3*a* of the recording paper 3. As an impact of this occasion becomes greater, the scale of the vibration becomes larger. The output level obtained at the moment of the disengagement of the separator 34 and the leading edge 3*a* is more greatly different from the other output levels in comparison with a case in that the separator 34 comes into contact with the paper roll 4 in a non-curvature state. Owing to this, it is possible to surely detect the leading edge 3*a* of the recording paper 3.

Incidentally, the separator 34 is utilized as an abutting member of the leading-edge detecting device, and the vibration detecting sensor 46 is attached to this separator 34 so that the structure is simplified.

Figure 6:
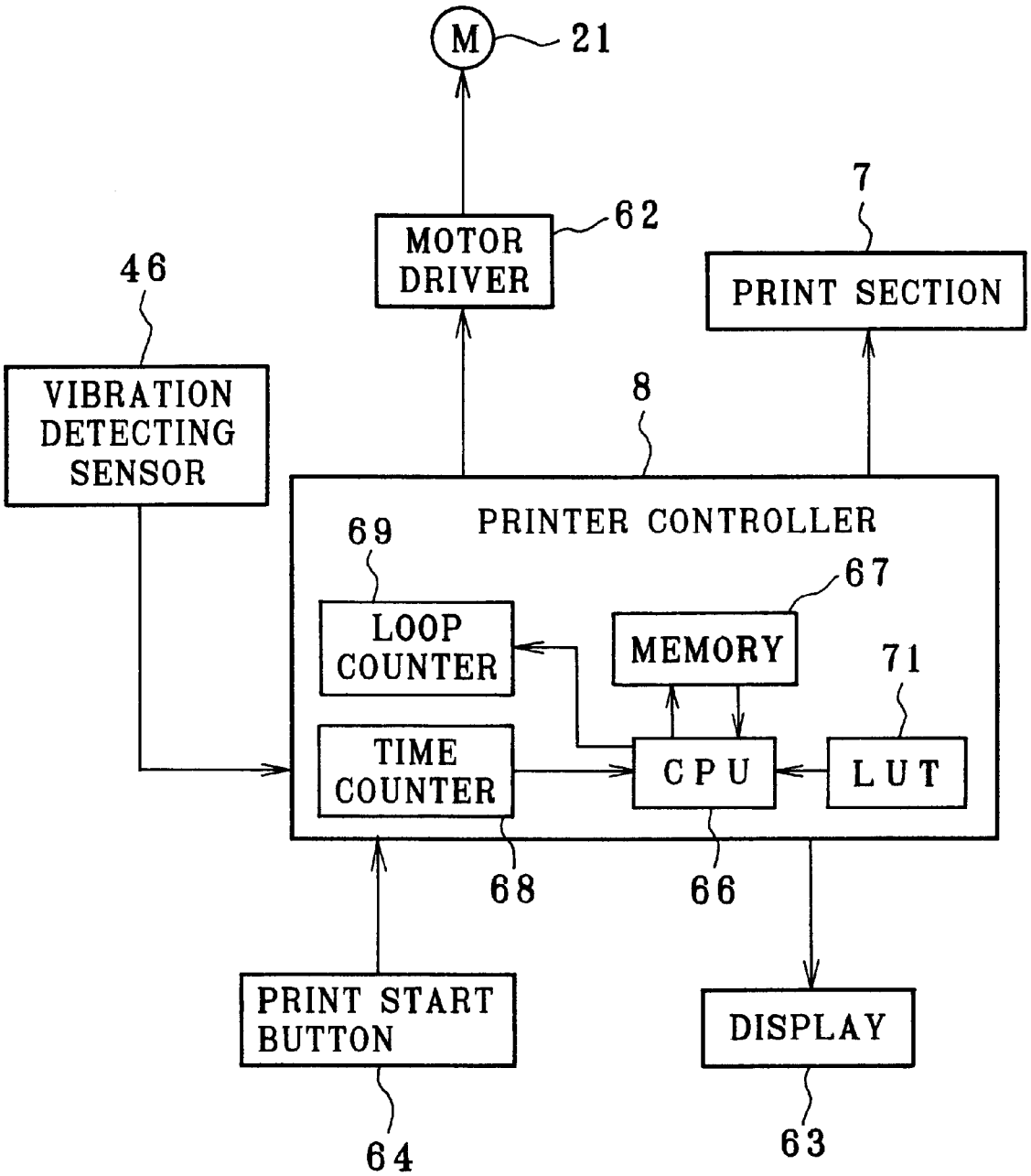
FIG. 6 is a block diagram showing a controller of the printer.

As shown in FIG. 6, the printer controller 8 is connected to a motor driver 62 and a display 63. The motor driver 62 controls the rotation of the drive motor 21. The display 63 reads an error message and a residual amount of the paper roll 4. By the way, printing is instructed with a print start button 64.

The printer controller 8 includes a CPU 66, a memory 67, a time counter 68, and a loop counter 69. The CPU 66 and the memory 67 execute the operation and the relative judgement. The time counter 68 measures a detection cycle of the leading edge 3*a* of the recording paper 3. The loop counter 69 counts the rotations of the paper roll 4.

The time counter 68 measures the detection cycle of the leading edge 3*a* while the paper roll 4 is rotated backward. The measured detection cycle is stored in the memory 67 and is compared with the detection cycle to be newly measured. When it is concluded from the comparison that the detection cycles of the leading edge 3*a* are substantially identical, it is judged that the secure winding of the paper roll 4 is completed.

The loop counter 69 is for rightly judging the completion of the secure winding. The loop counter 69 counts the rotations of the paper roll 4 after a difference between the last detection cycle and the current detection cycle has been included within a predetermined value. When a count number of the loop counter 69 exceeds a predetermined number "N" set in advance, completion of the secure winding is judged. Incidentally, the predetermined value of the difference is set such that the winding state of the paper roll 4 does not affect the operation of the printer.

The loop counter 69 is reset when printing is instructed and the backward rotation of the paper roll 4 is commenced in the winding direction. After that, upon detecting the leading edge 3*a* of the recording paper 3, "1" is added. In case the difference between the last detection cycle and the current detection cycle is not included in the predetermined value, the loop counter 69 is reset. When the difference is included in the predetermined value, the loop counter 69 is not reset and "1" is added at the time of the next detection of the leading edge 3*a*.

A predetermined period is set in an LUT 71 as a timer value. This predetermined period is set so as to exceed a period during which the leading edge 3*a* of the recording paper 3 makes one revolution on condition that the paper roll 4 has the maximum diameter. When the timer value or more has passed without detecting the leading edge 3*a* after commencing the backward rotation of the paper roll 4, the drive motor 21 is stopped. At the same time, the display 63 reads the error message to notify a trouble to a user.

The printer controller 8 calculates the residual amount of the paper roll 4 on the basis of the detection cycle of the leading edge 3*a* in the state that the secure winding of the paper roll 4 is completed. The residual amount is represented as a remaining printable number. The calculation is carried out, referring to the LUT 71 storing a relationship between the detection cycle T of the leading edge of the securely wound paper roll 4 and the remaining printable number. This relationship is obtained in advance from the diameter of the paper roll 4, the thickness of the recording paper 3, and the predetermined cut size.

Figure 7:
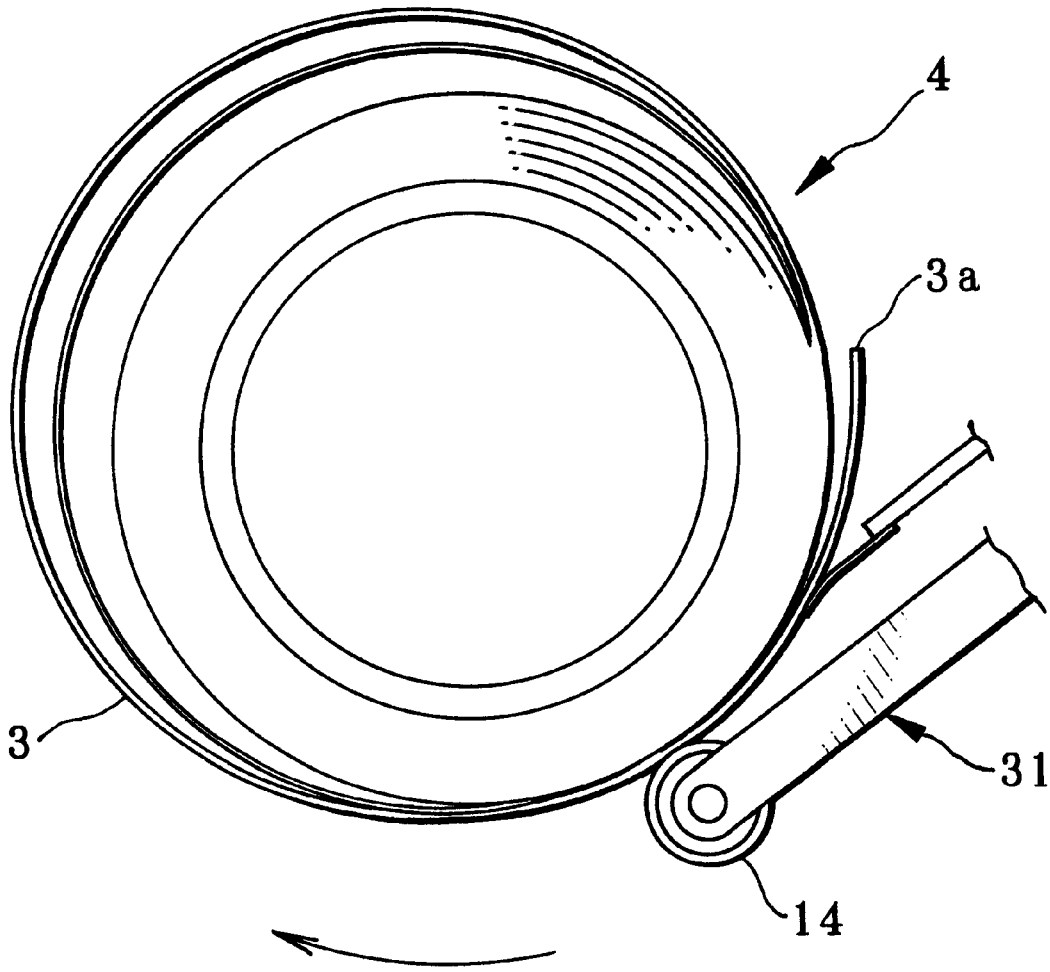
FIG. 7 is an illustration showing a looseness state of the paper roll.

In the meantime, when the paper roll 4 is wound in the looseness state such as shown in FIG. 7, it takes a longer time to make one revolution of the leading edge 3*a*. Thus, in the time counter 68 for measuring the detection cycle of the leading edge 3*a*, a count value T thereof becomes larger. When the paper roll 4 is reversed and is securely wound, the diameter of the paper roll 4 becomes smaller and the detection cycle of the leading edge 3*a* becomes shorter.

Consequently, the count value T of the time counter 68 becomes smaller every rotation. After completing the secure winding, the count value T substantially becomes a constant value. For instance, such as shown in FIG. 5, the count value T1 of the first rotation is larger than the count value T2 of the second rotation. Upon completion of the secure winding, the detection cycle T of the reading edge 3*a* substantially becomes a constant cycle. In other words, T(n−1) becomes equal to Tn. When this condition is satisfied, it is judged that the secure winding has been completed. After judging the completion of the secure winding, the rotation of the paper roll 4 is changed to the forward rotation in the paper feeding direction. As a matter of fact, the completion of the secure winding is judged when the detection cycle is substantially becomes a fixed cycle, since there are a measurement error and so forth. In view of this, a prescribed tolerance is predetermined from experiment. When the detection cycle is included within the tolerance, it is judged that the detection cycle is fixed.

Figure 8:
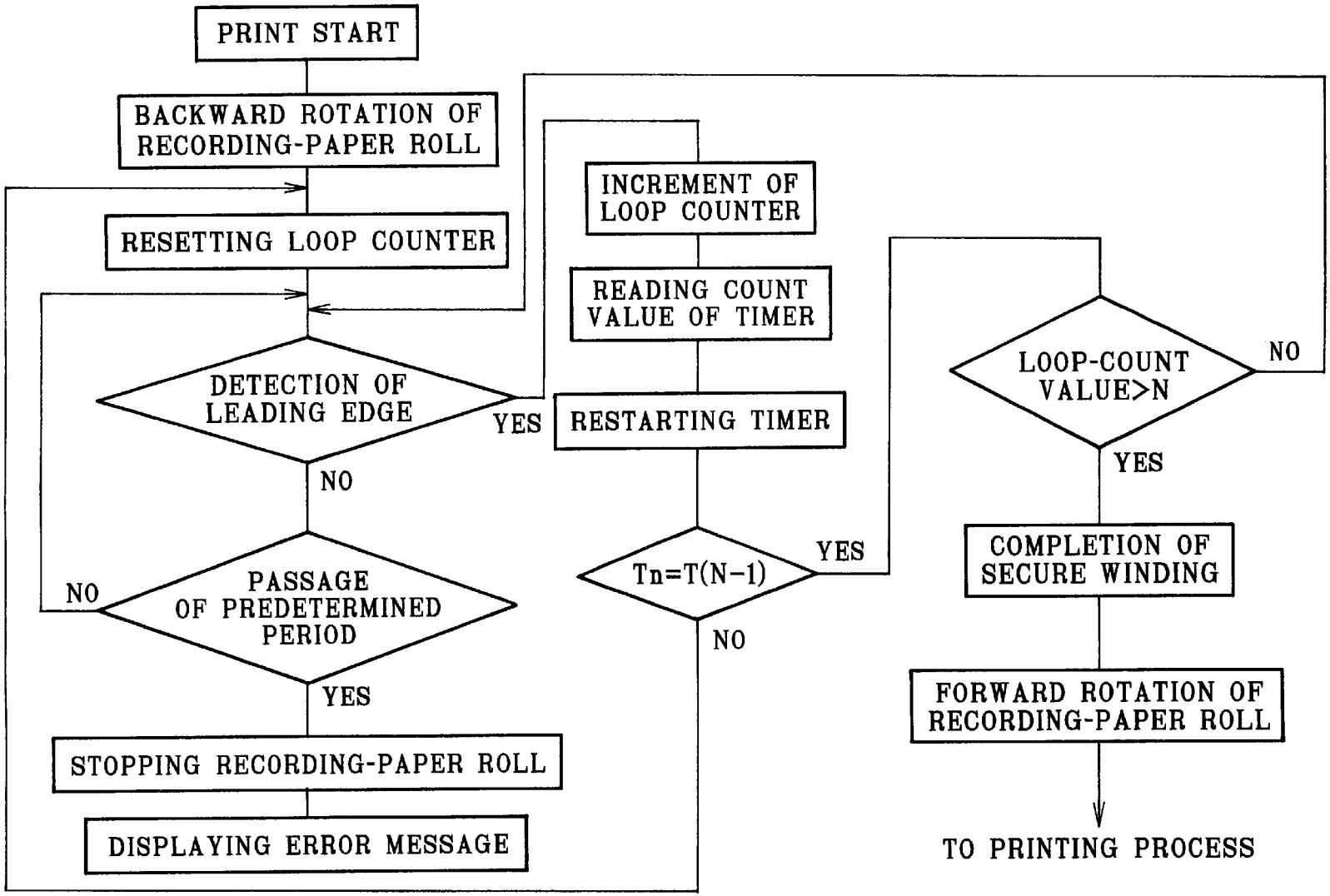
FIG. 8 is a flow chart showing a process for securely winding the paper roll.

Next, an operation of the above structure is described below, referring to FIG. 8. Upon depressing the print start button 64, the printer controller 8 commences, via the motor driver 62, actuating the drive motor 21 so as to rotate the drive roller 14 in a counterclockwise direction in the drawings. Owing to this, the paper roll 4 is rotated backward in the clockwise direction. Since the paper roll 4 contacts with the drive roller 14, the paper roll 4 of the looseness state is securely wound. By the way, the loop counter 69 is reset at the time of commencement of the backward rotation.

When the leading edge 3*a* of the recording paper 3 passes the separator 34 during the backward direction, they are disengaged from each other so that the output level of the vibration detecting sensor 46 exceeds the level L1. In response to this, the printer controller 8 judges the disengagement of the leading edge 3*a* and the separator 34 to detect the leading edge 3*a*.

Upon detecting the leading edge 3*a*, the printer controller 8 adds "1" to the loop counter 69. At the same time, the printer controller 8 makes a timer start. The paper roll 4 is successively rotated backward. When the leading edge 3 is detected again, "1" is further added to the loop counter 69. The count value T1 of the timer taken for one rotation is written in the memory 67. When the paper roll 4 is loosely wound, the difference between the last count value T(n−1) and the current count value Tn is not included in the predetermined range. In this case, the paper roll 4 is successively rotated backward. At the same time, the loop counter 69 is reset.

When the count value Tn of the timer substantially satisfies a condition of Tn=T(n−1), a loop-count value of the loop counter 69 is referred. If the loop-count value does not exceed the predetermined number N, the backward rotation is continued. At this time, since the count value Tn satisfies the condition of Tn=T(n−1), the loop counter 69 is not reset. And then, when the loop-count value exceeds the predetermined number N, it is judged that the secure winding of the paper roll 4 has been completed.

When the completion of the secure winding is judged, the paper roll 4 is stopped at a predetermined rotational position. After that, the rotation of the paper roll 4 is changed to the forward rotation. Upon rotating the paper roll 4 forward, the leading edge 3*a* of the recording paper 3 is separated from the paper roll 4 by the separator 34. The separated recording paper 3 is guided by the guide plates 41 and 42 to lead the leading edge 3*a* thereof to the paper mouth 17. In this way, the recording paper 3 is fed into the print section 7. The print section 7 executes the printing process. The printed recording paper 9 is cut in the prescribed size to be discharged to the outside of the printer 2. Incidentally, the non-printed recording paper 3 is rewound toward the paper roll 4.

Upon depressing the print start button 64 again, winding the paper roll 4 is performed. After completing the secure winding of the paper roll 4, the printing process is commenced. These operations are repeated until the paper roll 4 is used up. In virtue of the above-described structure, the leading edge 3*a* is stably detected until the paper roll 4 is used up. Hence, the leading edge 3*a* is correctly detected so that the secure winding of the paper roll 4 is properly performed.

Figure 9A:
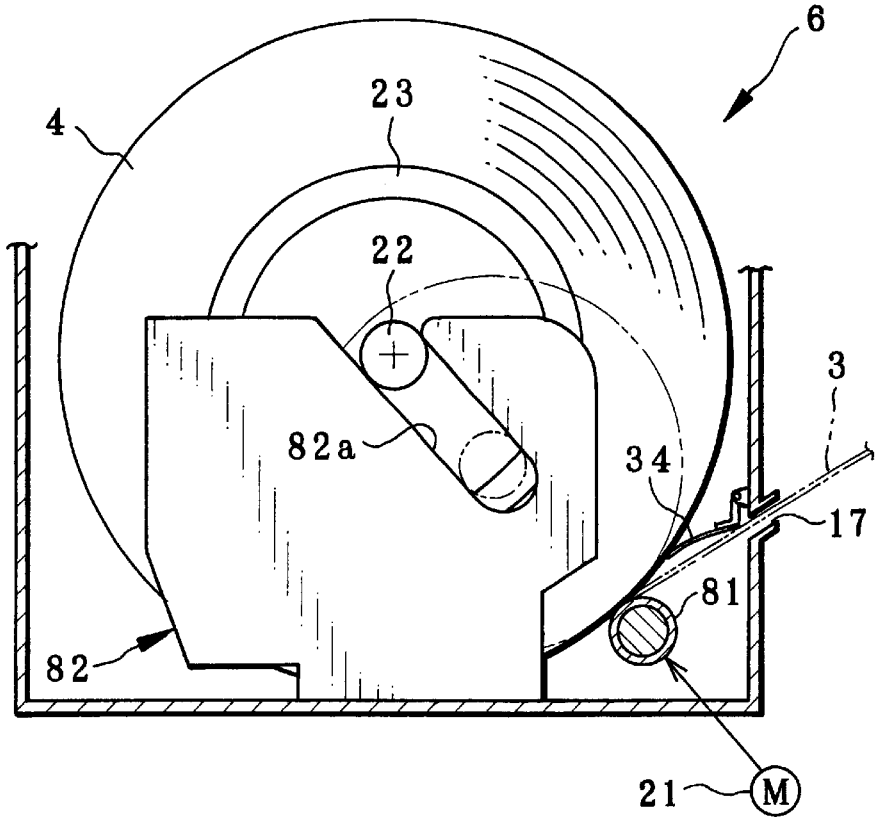
FIGS. 9A and 9B are explanatory illustrations showing another embodiment of the paper roll in which a rotary shaft is movably provided.
Figure 9B:
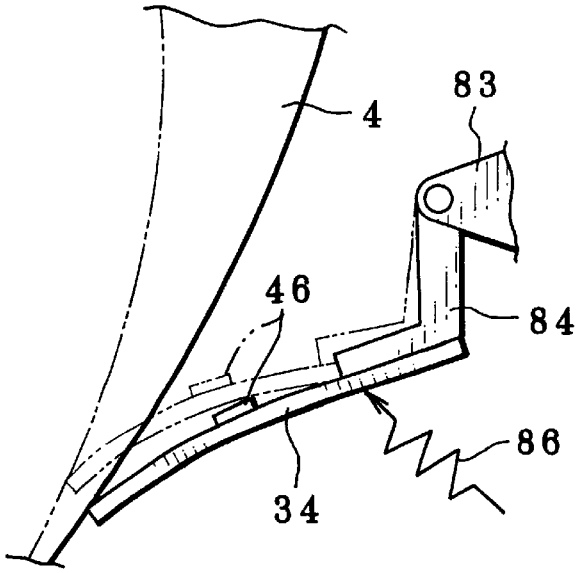

The above embodiment is described regarding the rotary-shaft fixation type in which the rotary shaft of the paper roll is rotatably supported at the fixed position. The present invention, however, may be applied to another type shown in FIG. 9. This type is a rotary-shaft movement type in which a drive roller 81 abutting on the periphery of the paper roll 4 is disposed at a fixed position. In this type, the rotary shaft 22 is moved toward the drive roller 81 in accordance with the diameter change of the paper roll 4. In FIGS. 9A and 9B, members being identical with the foregoing embodiment are denoted by the same reference numerals.

In FIG. 9A, a support plate 82 rotatably supports the paper roll 4. The support plate 82 is formed with a slit 82*a* for moving the paper roll 4 toward the drive roller 81. The rotary shaft 22 is inserted into the slit 82*a*. The paper roll 4 is pressed against the drive roller 81 along the slit 82*a* by means of a press member (not shown) abutting on the rotary shaft 22.

As the recording paper 3 is used, the diameter of the paper roll 4 becomes smaller. In accordance with the diameter, the rotary shaft 22 moves within the slit 82*a* to always contact the periphery of the paper roll 4 with the drive roller 81. Owing to this, the paper roll 4 is properly rotated from beginning to end while it is used.

The separator 34 is attached to a second supporting arm 84 and is disposed near the drive roller 81. The second supporting arm 84 is rotatably attached to a supporter 83 and is urged by a second spring 86 in the clockwise direction in FIG. 9B. Thus, the separator 34 is moved in accordance with the diameter change of the paper roll 4. The vibration detecting sensor 46 is attached to the separator 34.

In the rotary-shaft movement type, it is unnecessary to provide the first supporting arm, which is for supporting the drive roller, and the first spring. By disposing the separator 34 near the drive roller, it is possible to reduce a movement amount of the separator moving in accordance with the diameter change of the paper roll 4. Owing to this, the urging force of the second spring 86 is prevented from largely changing, regardless of the diameter of the paper roll 4. Consequently, the vibration detecting sensor 46 stably works so that the leading edge is correctly detected.

Incidentally, when the separator 34 is approached more close to the drive roller, the separator 34 is hardly affected by the diameter change of the paper roll 4. In this case, the second supporting arm may be omitted. Moreover, it is possible to contact the separator 34 with the paper roll 4 only by flexibility of the separator itself, from beginning to end while the paper roll 4 is used. Hence, the second spring may be also omitted. In doing so, the structure of the leading-edge detecting device is simplified.

In the above embodiment, the leading edge is detected on the basis of the signal level outputted from the vibration detecting sensor. However, as the vibration detecting sensor, it is possible to employ a sensor which outputs a pulse signal when detecting the vibration of a predetermined scale. On the basis of the pulse signal, the leading edge may be detected.

The above embodiment is described regarding the color thermal printer using the color thermosensitive recording paper. The present invention, however, may be applied to a photo printer in which printing is performed for a photographic paper. Further, the present invention may be applied to another printer using the other paper roll.

Moreover, in the above embodiment, the paper roll is contained in the chamber provided in the printer. However, the paper roll may be contained in a paper magazine, which is removably set to the printer.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A device for detecting a leading edge of a strip of a recording paper having a form of a paper roll, said leading edge existing on a periphery of said paper roll before paper feed of said recording paper, said leading-edge detecting device comprising:

a driving member for rotating said paper roll in a wind direction before said recording paper is fed by rotating said paper roll in an unwind direction;

an abutting member for contacting with the periphery of said paper roll, said abutting member vibrating when said leading edge has passed under the rotation of said paper roll in the wind direction;

a vibration detecting sensor for detecting a vibration of said abutting member; and judgement means for judging a moment that said leading edge has passed said abutting member under the rotation of said paper roll in the wind direction, on the basis of a change of a signal outputted from said vibration detecting sensor.

2. A leading-edge detecting device according to claim 1, wherein a head portion of said abutting member contacts with the periphery of said paper roll, and said abutting member separates said leading edge from said paper roll by abutting thereon when said paper roll is rotated in the unwind direction.

3. A leading-edge detecting device according to claim 2, wherein said abutting member is formed from a plastic thin plate having flexibility and contacts with the periphery of said paper roll in a curvature state.

4. A leading-edge detecting device according to claim 1, wherein said vibration detecting sensor is attached to said abutting member.

5. A leading-edge detecting device according to claim 4, wherein said judgment means judges the moment that said leading edge has passed said abutting member when an output level of said vibration detecting sensor exceeds a predetermined level.

6. A leading-edge detecting device according to claim 5, wherein said paper roll is rotated in the wind direction for securely winding said paper roll, and the secure winding is completed when a number of the rotation of said paper roll reaches a predetermined number after intervals for detecting said leading edge have been identical.

7. A leading-edge detecting device according to claim 1, wherein said driving member includes a drive roller for contacting with and rotating said paper roll.

8. A leading-edge detecting device according to claim 7, wherein said abutting member is disposed near the drive roller.

9. A leading-edge detecting device according to claim 7, further comprising:

a shaft attached to said paper roll, said shaft being kept at a fixed position;

a first supporting arm for supporting said drive roller, said first supporting arm making said drive roller movable in accordance with a diameter change of said paper roll rotating around said shaft of the fixed position; and a first spring for urging said first supporting arm so as to contact said drive roller with the periphery of said paper roll.

10. A leading-edge detecting device according to claim 9, further comprising:

a supporter for rotatably supporting said first supporting arm.

11. A leading-edge detecting device according to claim 10, wherein said first supporting arm has an L-figure shape, said drive roller being attached to one end of said first supporting arm and the other end thereof being rotatably attached to said supporter.

12. A leading-edge detecting device according to claim 9, further comprising:

a second supporting arm for supporting said abutting member, said second supporting arm making said abutting member movable in accordance with the diameter change of said paper roll rotating around said shaft of the fixed position; and a second spring for urging said second supporting arm so as to contact said abutting member with the periphery of said paper roll, said second spring being attached to said first supporting arm so as to move together therewith.

13. A leading-edge detecting device according to claim 12, further comprising:

a supporter for rotatably supporting said second supporting arm.

14. A leading-edge detecting device according to claim 13, wherein said second supporting arm has an L-figure shape, said abutting member is attached to one end of said second supporting arm and the other end thereof being rotatably attached to said supporter.

15. A leading-edge detecting device according to claim 7, further comprising:

a shaft attached to said paper roll, said shaft being moved toward said drive roller in accordance with a diameter change of said paper roll; and a support plate for movably supporting said shaft.

16. A leading-edge detecting device according to claim 15, wherein said support plate is formed with a slit, along which said shaft is moved.

17. A leading-edge detecting device according to claim 16, further comprising:

a supporting arm for supporting said abutting member; and a spring for urging said supporting arm so as to contact said abutting member with the periphery of said paper roll.

18. A leading-edge detecting device according to claim 17, further comprising:

a supporter for rotatably supporting said supporting arm.

19. A leading-edge detecting device according to claim 18, wherein said supporting arm has an L-figure shape, said abutting member being attached to one end of said supporting arm and the other end thereof being rotatably attached to said supporter.

* * * * *